United States Patent [19]

Suhr et al.

[11] Patent Number: 4,695,093

[45] Date of Patent: Sep. 22, 1987

[54] WORK CHAIR

[75] Inventors: Heinz-Peter Suhr, Grossbottwar; Bernd Weinberger, Steinheim, both of Fed. Rep. of Germany

[73] Assignee: Firma August Froscher G.m.b.H. & Co. K.G., Steinheim, Fed. Rep. of Germany

[21] Appl. No.: 872,279

[22] Filed: Jun. 9, 1986

[30] Foreign Application Priority Data

Jun. 14, 1985 [DE] Fed. Rep. of Germany ..... 3521488

[51] Int. Cl.[4] ..... A47C 3/00; A47C 1/032

[52] U.S. Cl. ..... 297/300; 297/312

[58] Field of Search ..... 297/300, 304, 312, 340, 297/320, 316, 321

[56] References Cited

U.S. PATENT DOCUMENTS

| | | | |
|---|---|---|---|
| 4,143,910 | 3/1979 | Geffers et al. | 297/320 |
| 4,380,352 | 4/1983 | Diffrient | 297/312 |
| 4,390,206 | 6/1983 | Faiks et al. | 297/300 |
| 4,411,469 | 10/1983 | Drabert et al. | 297/300 |
| 4,521,053 | 6/1985 | DeBoer | 297/312 |

*Primary Examiner*—James T. McCall

*Attorney, Agent, or Firm*—Robert E. Burns; Emmanuel J. Lobato

[57] ABSTRACT

A work chair (10) has a seat (15) divided into a forward seat part (15.1) and a rear seat part (15.3) of which the forward seat frame part (17.1) and rear seat and back frame part (17.2) are connected with one another by a hinge joint with a hinge axis (18). The frame parts are supported on a pedestal (11) by seat frame supports (20,21). On the column (13) of the pedestal there is provided a column support part (25) which carries the pivot axis (23) and a swivel support part (28). On the pivot axis (23) seat frame supports (21) are mounted. The swivel support part (28) is tiltable by means of an inclination adjusting device with an actuating handle (6) for tilting the plane (E). The swivel support part (28) has forwardly an elongated bearing opening in which the sliding axis (22) is slidable against the force of an adjustable spring. The sliding axis (22) carries the seat frame support (20). The sliding axis can be secured against sliding by an arresting device having an arresting lever (51) with a swivel bar (52). The spring force can be adjusted by means of an elbow lever. For this purpose a grip (45.4) is provided. By swinging the arresting lever (51) up, a pivoting about the pivot axis (23) can be effected by pressure on the backrest (16) with a lowering of the rear surface of the seat (15), while the forward rounded seat region (15.6) maintains its height.

23 Claims, 9 Drawing Figures

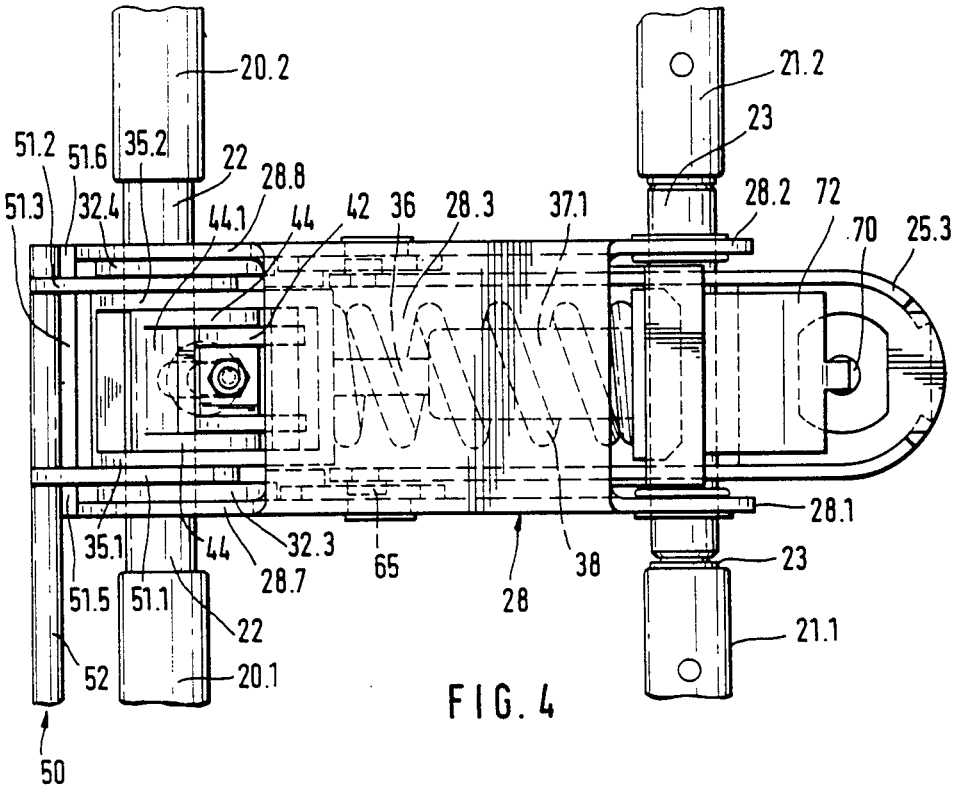
FIG. 4
FIG. 5
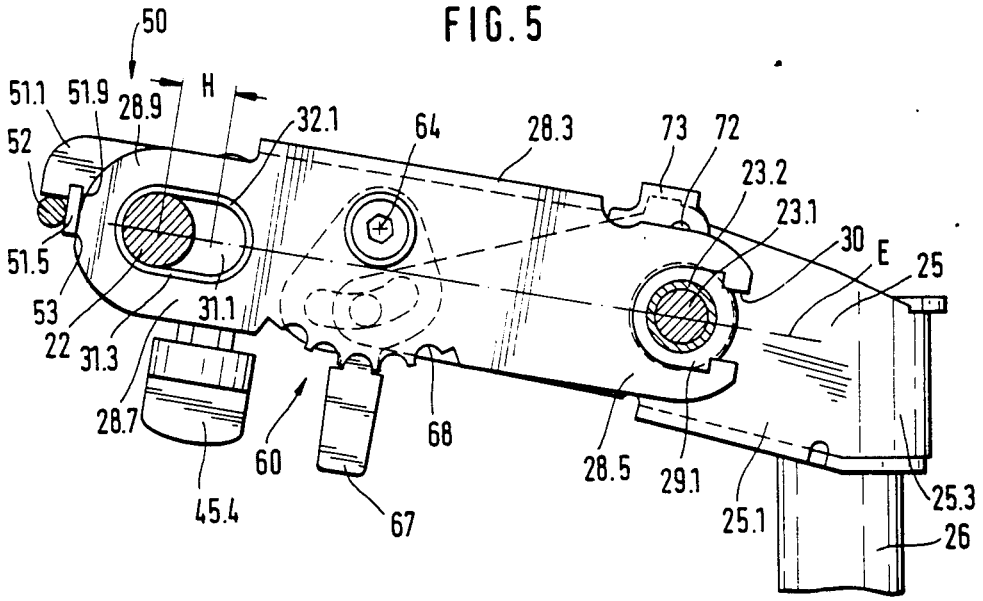

WORK CHAIR

FIELD OF INVENTION

The invention relates to an work chair with seat and backrest as well as with support and adjustment mechanism whereby the seat and the backrest are divided into at least two parts which are hingedly connected with one another which with the help of seat and backrest supporting levers or arms are supported on the support and adjustment mechanism structural parts.

BACKGROUND OF THE INVENTION

Work chairs should conform with their body supporting surfaces to the different seating positions of the user. Thereto, there have been many proposals. Thus, the seat and backrest, for example, are divided into several parts and hingedly or adjustably connected with one another. As the user, during the day, frequently changes his seating position, the chair mechanism is also provided so that it automatically conforms to the position of the user.

There are basically three seating positions. In the forwardly-bent seating position for writing or for reading from material lying on the table top, the back is inclined forwardly. In the upright seating position, in particular in the use of machines, the back stands approximately vertical. In the relaxed or listening position, for example when telephoning or speaking, it is suitable for the back to be inclined rearwardly. These three seating positions should be assume without problems and optimal support should be provided for the respective body parts.

Especially in the rearwardly inclined relaxing, or listening position, the seat surface should no longer lie horizontal because otherwise a slipping is to be feared and this is opposed by friction of the seat material whereby, however, slipping between the clothing the body of the user can occur. Therefore, it is desirable for the seat to be inclined rearwardly. It is sought to effect the change to these different positions by suitable supporting and adjusting mechanism of the chair in order to achieve a so-called dynamic seating. Thereby, an articulated connection between the seat and beackrest is provided as for example according to DE-OS No. 33 22 450 or DE-OS No. 30 36 993 whereby in the first case an articulated construction with a fixed pivot axis, and in the second case a bendable connection between the seat and the backrest is provided. A plurality of other construction are also known. They differ essentially in the precise position of the point of articulation and the length of the lever of the linkage in order to achieve the proper relationship between the parts. Many constructions seek to position the pivot axis of the different support surfaces so as to conform with the pivot points of the user's joints. In many cases, this is not achieved and hence in many support and movement lapses, there are anatomically unfavorable support and movement relationships.

In the forwardly inclined writing position, the back as a rule has no contact with the backrest. Upon backward movement, such contact first begins approximately upon reaching the upright machine operating position. It has been shown that it is advantageous to maintain the support between the lower lumbar vertebra and the pelvis in an unaltered angle position and to adapt the movement of the kinematic to this relationship. Such construction is known basically from DE-GM No. 77

21 954. Thereby are the seat and backrest formed of three parts whereby the seat part is divided into a flat part and a rear wedge part. The flat part and wedge part are connected with one another through a horizontal transverse axis. The wedge part and the backrest can be fast with one another or can be connected with one another through an elastic connection. The supporting kinematics are so selected that upon the backrest being pressed rearwardly against a self-blocking air-spring, the angle between the flat part and the wedge part of the seat part is increased and the forward region of the flat part of the seat supporting the upper thigh is raised while the wedge part as a whole is lowered and to an almost horizontal end position. The flat part is thereby supported by a fixed articulation axis lying in the region of the articulation axis between the flat part and the wedge part and a probably slidable support in approximately the middle region of the flat on a seesaw. The seesaw in turn is linked on the chair frame far forwardly of the articulation axis of the flat part and has a seesaw-like support lever extending under the other articulation axis on which the wedge part is fixed. The seesaw is provided on the rear end in the region between the wedge part and the back part with an articulated support on a self-blocking air-spring. The self-blocking air-spring in turn is arranged forwardly and downwardly inclined and is there linked to the frame. This mechanism requires a plurality of toggle joints with six pivot axes or pivot regions. Moreover, this kinematic gives quite a special movement and is selected so that the forward region of the flat part of the seat is raised upon tilting rearwardly. The feet are thereby lifted from the floor. A kinematic of this kind is not suitable for all three work positions of the chair. Various other efforts show that the forward-most seat region is maintained at a constant height and that therefore a linkage and/or sliding support is provided there, for example according to DE-OS No. 33 22 450 or DE-GM No. 78 15 561.

The construction according to DE-GM No. 77 21 954 also lacks a construction which makes possible a long sitting in the forwardly bent handwriting position with which namely the seating surface is inclined forwardly slightly downwardly. It is thus not suitable for the practical requirements for which it is important that the seat and backrest optimally conform to the various positions of use of persons working in different manners.

With the construction according to DE-OS No. 33 22 450 and DE-GM 78 18 561 as well as with many other constructions, there is a backrest carrier which is linked rigidly to the frame in the region of the column and on which the seat is linked in variable angle positions to the backrest whereby upon leaning back, there is a deviation between the pelvis and the spinal column which is undesirable. The linked support between the rear surface of the seat according to DE-GM No. 78 15 561 at best enables a stretch position between the two seat surface parts, however, no further lowering of the rear end of the seat which opposes the natural support of the forces in the rearwardly leaning position.

With the construction according to DE-OS No. 30 36 993 there is support of the seat and backrest with only few linked axes and a linkage coupling between the seat and backrest which works together with the few supports. However, these supports are provided outside the seat and hence not suitable for many chair construction. There is also a forwardly leaning arrangement which does not lift the thigh on leaning back but changes the angular position between the pelvis and spinal column upon leaning back in a manner that is undesired by many users and it requires a spring linkage construction between the seat and backrest. The inclination of the seat surface is constantly connected with a corresponding inclination of the backrest which is likewise undesired for many users or use situations. From DE-GM No. 76 12 629, there is known an arrangement for adjusting the seat inclination with which the seat can be adjusted in its inclination with respect to the foot frame with a curved disc arrangement. The backrest on its part is arranged in an adjustable position on the foot frame. They are not coupled with one another. This chair is not suitable for a dynamic seating. It shows, however, how with an inclination adjusting cam disc and a link axis, there can be realized a suitable inclined position in which at the same time the cam disc construction is immobilized. For a direct use in a support mechanism for a dynamic seat and backrest support, this arrangement however is not suitable.

SUMMARY OF THE INVENTION

The invention is directed to the problem of providing for a work chair, a support and adjustment device which with simple construction and anatomically favorable support enables the pre-selectable and/or automatically adjusting relative positions of the different support elements of the seat and backrest in a simple and reliably functioning manner.

In accordance with the invention, there is provided a work chair of the kind referred to above with the seat and back supports for the body of the user divided into a plurality of zones which are supported on a base frame with suitable kinematics corresponding to the dynamics of the user in different work positions by support and adjustment mechanism, by improving the construction of the support and adjustment mechanisms in several directions, namely relative to the selection of the position of the articulation points, the length and angle of the linkage levers to form a suitable simple kinematic, the inclined position of the links to one another and the spring connection of the movable parts to one another, preferably with arresting means and preferably in a compact, stable, easily manufactured and easily assembled construction of the support and adjustment mechanism, whereby the parts work together as a whole, but in their individual regions can be subject to different variations and moreover, can also be used in the form of sub-combinations and moreover, in otherwise formed chair support mechanisms.

According to a first solution, there is provided a work chair with seat and backrest as well as a pedestal with support and adjusting mechanism in which the seat is divided into a forward seat surface portion and a rear seat surface portion which are hingedly connected with one another and the backrest is joined with the rear seat surface part at a substantially unalterable angle. The seat surface parts are supported hingedly on the frame and movable relative to one another in their relative angular positions against the spring force whereby the rear seat surface part is supported on a hinge axis fast on the frame lying under the hinge axis between the seat surface parts in such manner that from the forwardmost stop position of the spring support it is inclined downwardly to the rear by the pressure of the backrest. In accordance with the invention, the two seat surface parts hingedly connected with one another are supported by only one support or by a pair of supports on the frame and the forward seat surface part has, near the front end of the seat, its hinge axis fast on the frame. The hinge axis of the rear seat surface part lies behind the hinge axis of the forward seat surface part and one of the hinge axis is arranged movably against the force of a spring.

Through the above-mentioned combination of features, with a chair in which a rear seat surface part and the backrest are at an essentially unalterable angle to one another and the rear surface part is depressed upon backward leaning of the backrest—which is per se known through wholly differently built supports—the legs will no longer be raised because the forwardmost support remains practically at the same height in movement of the seat as a result of leaning back. Not only that, but moreover the number of hinged axes and the number of support levers is considerably reduced and a more favorable position for the linking on the frame is made possible which leads to a smaller and more compact but nevertheless more stable support and, above all, makes possible a better flow of movement more favorable to the anatomical relationship, whereby additionally simple possibilities for inclination adjustment and the construction of an adjustable springing is provided. Thereby, it is important that the hinge axes no longer lie inverted to one another as compared with the original construction and a seat joint lying on a support immediately in the region between the seat surface parts can be dispensed with as considered always to be necessary in previous construcitons according to DE-PS No. 1 256 840, DE-GM No. 77 21 954 and DE-GM No. 78 15 561 whereby the number of supports and the toggle joints is considerably reduced and on account of the short support length by favorable flow of movement and favorable support relationships, a very stable support is made possible.

According to one embodiment, the seat surface parts can be formed with the help of two frame parts or two frame-like shell parts hingedly joined with one another under which there are fastened downwardly and inwardly extending seat frame supports which have insertable fastening parts or the like on the hinge axis. Thus with simple means, the support can be achieved in a stable manner and the forces on the seat are transmitted, mainly those relative to the load of a person applied to the seat as well as relative to the transmission of support forces from the forward seat region over the rear seat region to the backrest and vice versa.

To make possible a favorable movement cycle with optimal kinematic relations, it is advantageous to provide the fixed hinge axis directly in front of the column of the pedestal and let the hinge axis of the seat surface parts lie between vertical parallel planes through the vertical column and the swivel axis. Thus, the hinge axis and the support on the pedestal in this region lie close to one another and thereby enable the favorable transmission of forces and especially the especially favorable movement cycle of the rear seat surface parts whereby these begin to tilt from a position slightly over the dead center position to a rearwardly inclined position when the backrest is inclined rearwardly.

The plane in which both of the hinge axes of the support lie and the seat frame plane or the main seat surface plane converge in the forward, spring-abutment position, preferable in an acute angle of a few degrees. Thereby, it is possible on the one hand in the vertical machine operating seat position to have a horizontal position of the seat surface and a corresponding favorable support for the backrest and on the other hand with suitable adjustment, have the seat surface forwardly inclined in order to occupy the forwardly inclined writing position and nevertheless by favorable kinematics achieve the relaxed and listening position with favorable support of the buttocks with few linkage points.

The location of the hinge axes and the length of lever arms are advantageously selected so that the foward seat part is tiltable against spring force through an angle of about 3° and the backrest is tiltable through an angle of about 16° . Then, through the special construction with the joints and the compensation in the seat shell and the upholstering, there is obtained an angular relationship of 1:2.5 to 1:3 which is favorable for the relative angular inclination between the seat and the backrest in the rearmost position.

In itself, the sliding axis can be provided in the region of the pedestal if the other structure is correspondingly selected. However, it is especially advantageous for the pivot axis on the column support part to be unslidable and for the forward pivot axis on the swivel support part to be slidable rearwardly against spring force. Thus, the entire hinge part supporting the fixed rear axis is made solid and tilt-free and the foward axis is made as a slidable axis whereby the stability will not impaired. An essential advantage is to be seen therein that the spring force is now transmitted over the forward seat part and its support as anchoring member to the backrest, whereby favorable leverage and force transmission relationships are obtained. Moreover, an adjustment stop can be favorable accommodated in the region of the sliding axis which is desirable since a seat height adjustment is as a rule needed in the rear. Moreover, a spring force adjustment device is favorably provided in the vicinity of the sliding axis where—because of its lying forwardly—, it is easily actuated. The advantageous construction of the kinematics with their favorable hinge axes and lever arms permits an advantageous construction in which the seat frame carrier can be far extended to under the seat edge while the supports of the hinge axes in the vicinity of the column of the pedestal are formed as bearing rotationally fixed with the support tube.

Another advantageous part of the solution in accordance with the invention which in conjunction with the aforementioned characteristics but also usable in combination with its own characteristics, is that a work chair with seat and backrest as well as pedestal with support and adjusting mechanism, whereby the seat and backrest are movably supported on hinge axes fast with the frame and against spring force in their angle positions, the feature that the seat and the backrest are supported on the supports of the pedestal by only two supports or two pairs of supports of which one support hinge axis (swivel axis) is fast on the part of the support and adjustment mechanism which is fixedly connected with the pedestal and whereby the other hinge axis is supported on a swivel support part which in turn is tiltably supported on the first mentioned hinge axis (swivel axis) fast on the pedestal, and whereby between the column support part fast on the pedestal and the swivel support part, there is arranged an inclination adjustment device by means of which the relative height positions of the inclination tiltably supported hinge axis (sliding axis) is variable relative to the fixed hinge axis (swivel axis) on the pedestal. Through this construction, there is provided on one hand, apart from the above-mentioned dynamic tilting or inclination of the seat surface parts and backrest parts against spring force, an additional inclination adjustment possibility which permits the initial position of the seat and/or backrest to be adjusted and that with the required present or necessary axis, whereby the one hinge axis is drawn up simultaneously with support of the seat part and support of the support part, whereby the number of the construction parts is reduced and the facility of inspection of the construction and kinematics is improved without the need of inspecting the inclination possibilities by special construction of the kinematics in special lever length or position of the axes. Such an inclination adjustment can also be undertaken when the one axis is not sprung and the springing is provided in a position other than in the exemplified embodiment and when the backrest is not fast with a sear part. For the adjustment of the previous construction, it is however of particular importance to provide a basic inclination adjustment because thereby the initial position especially for the forwardly bent writing position and the accommodation of the other user requirements with simply means is considerably facilitated.

The inclination adjustment device can be achieved in various ways, for example through interposed screw parts or the like. An especially advantageous construction provides that the inclination adjustment device is formed with the help of at least one cam disc rotatable about an axis provided on one of the opposed adjustable support parts on which a cam follower element fast on another support part, for example a coupled pin, engages, and whereby an adjustment handle and detent means are provided. While a screw device requires a corresponding thread and a corresponding space, a cam adjusting device can be made flat and the cam pitch can readily be made as desired. They can readily be formed as die stamped and turned or formed parts.

In an advantageous embodiment in which the housing of a spring is also taken into account, there is advantageously provided a column support part with two forwardly directed arm-form, guide plates embracing a spring space whereby these in the region of the forward ends have outwardly directed coupling pins which engage in the cam slots of the inclination cam discs which in turn lie on the outer surfaces with only working play and in the inside of the support shank overlapping the column support shank and the inclination cam discs lies a U-shank support part overlapping all other construction parts of the support and adjusting mechanism whereby the inclination cam discs are supported with the help of a preferably divided rotation axis on the shank support part. With such an arrangement, it is advantageous for the support shank of the swivel support part to have stop recesses which are of part-circular shape surrounding the axis of rotation in the lower edge of the support shank and in which the stop projections of an actuating handle connecting the two inclination cam discs engage. A such simple to produce and simple to assemble construction is moreover in a favorable position for actuation and affords great security in operation.

The above-described support and ajustment mechanism with a spring connection between the individual regions of the body support requires, in a suitable position, a suitably designed and suitably dimensioned spring which can be formed in several ways. Through the favorable construction of the kinematic connections and above all through the back spring force being exerted over long lever elements working as coupling members and then small sliding movement of the axis, a single, strong compression spring is to be accommodated. As the user may wish a different back position force, it is necessary for the spring force of such a strong compression spring to be easily adjustable. The previously used wedge and lever arrangements are on the one hand expensive to construct and on the other hand are often difficult to use and can moreover through long use lose their user friendliness. Accordingly, a further part of the construction in accordance with the invention provides an advantageous spring force adjusting device which co-operates with the other above-mentioned features especially with respect to installation in the housing but can also be used in chairs with other kinematic relationships.

There is thereby provided a work chair with seat and backrest as well as a pedestal with support and adjustment mechanism whereby the seat and the backrest are divided into at least two parts which are hingedly connected with one another and with the parts supported by separate support levers between which and/or between their support elements, there is provided at least one spring with an adjustment device for varying the spring force. A feature is that the spring force adjusting device is formed with an elbow lever which is variable in its angular position and which has in the elbow joint an elbow element which is adjustable by means of a set screw pressing on one elbow lever support element (elbow lever housing). The elbow lever arrangement permits, with a simple construction, favorable support and friction relationships which in their support spacing provide high forces with small actuating force. These are the requirements that a chair spring adjustment needs, which however were not heretofore applied in this place althought there are many spring adjusting devices, for example with screws and large actuating heads and the like for relatively strong springs. Here, the elbow lever arrangement has an especially favorable application because the spring force of a pressure screw spring progressively increases with compression and the adjusting force of an elbow lever decreases with increased lengthening on account of the varying angle position. This kind of favorable union of two characteristics for a small structural arrangement assures long, secure and easy-to-serve operation. Thereby, it is advantageous to insert the elbow lever arrangement in the actual direction of a compression spring and together with this in the plane of the two hinge axes (pivot axis and sliding axis) on which it bears. Thus, no further transmission mechanism is needed and the force is favorably applied directly. The elbow lever arrangement can advantageously be arranged in a forwardly and upwardly opening box-like elbow lever housing which on one hand supports the adjustment screw working on the elbow lever and on the other hand provides a bearing support for the elbow lever and moreover, a spring support. Such a box-like element is preferably formed with parallel walls accommodating the support and adjustment mechanism and favorably meeting the fabrication and servicing requirements for the other elements. Thereby the spring support can advantageously be a spring support wall of the elbow lever housing of which the support surface carries a guide pin on which an opposed spring bearing part is slidable and which holds and centers the compression spring between its support region and the spring support wall. There is thus provided an easily produced and favorably installed spring and spring adjustment unit. The opposed spring bearing part has advantageously a part-cylindrical bearing surface for bearing on the hinge axis or its axis tube. The forward part of the elbow lever which is turned towards the sliding axis has advantageously a part-cylindrical bearing element which is supported directly on the sliding axis. Thus, the support and bearing elements for the only slightly turning support are favorable integrated without any additional structural parts. The elbow lever parts are preferably formed of double arm interengaging elements of which the rear element is supported in the elbow lever housing by a support pin.

For many users of a work chair, the spring support of the backrest and the seat is not desired. It is therefore advantageous to form the sliding and spring possibilities so that they can be switched off or arrested. Therefore, the sliding axis or the spring device can advantageously be provided with a sliding movement-hindering or arresting device. This can engage either in the region of the sliding element of the spring or directly in the region of the slidable axis. It can thereby advantageously be provided that the arresting device is formed with an arresting swivel lever rotatable about the sliding axis which in the arresting position in approximately the plane connecting the axes bears on housing parts of the swivel support parts having the longitudinal sliding bearing and when out of the arresting position, is rotatable about 90° to a position parallel to the sliding plane. Such a lever can be easily formed, mounted and favorable actuated. The arresting device can thereby have two disc-formed arms which are arranged outside of and embrace the elbow lever housing and on which the limiting collars of the slide bearing for a mutual position fixing are engageable from the outside. Thus the interengaging elements are accommodated in a favorable and space-saving manner inspite of the relatively large torsion resistant support basis. The disc-form arms can be connected with one another by an arresting cross piece of which the arresting ends project beyond the disc-form arms and lie in the region of the support shank of the swivel support parts and whereby the arresting swivel lever has a swivel rod with a handle which preferably lies laterally under the forward region of the seat. Such a construction is easy to produce and consists of few parts and can be easily mounted and serviced.

Because of the wide loaded seat surface in contrast with support by a single column, usual chair mechanisms are made very wide in order to be able to resist the forces to which they are subjected. Hence, under the seat and often in the region of the backrest, there is required a large space for the different support and actuating elements which requires a large cover whereby the chair loses the appearance of a slender object. Moreover, many reciprocal slide arresting means such as securing rings, spacers and the like are needed. The invention now shows an attractive and also construction and production as well as assembly-favorable way of mounting a chair with a secure torsion-stiff box-like construction which can be used in work chairs with the aforesaid characteristics as well as in other chairs with the following combination of evident characteristics. There is thereby provided a work chair with seat and backrest as well as pedestal with support and adjusting mechanism whereby the seat and backrest are divided into at least two parts hingedly connected with one another which with the help of seat and backrest part supporting levers are supported on the support and adjusting mechanism, the characteristic that various support and adjusting elements are formed as a plurality of partially open U-form support and adjusting parts assembled one inside another. Moreover, there is a box-like housing which on the one hand is easily produced of molded and bent parts and on the other hand through the close spacing of the walls prevents unwanted movement but permits desired movement and thereby provides a large support base for the rotatable but torsionally stiff support of many parts. It is also assembly friendly and easy to inspect. Thereby the swivel support part is formed as a downwardly opening bearing part of which the end regions receiving the swivel bearing and the sliding bearing are formed as three projections from the connecting web. Thus, there is an outer overlapping stable structure part, the bearing of which is accessible and which nevertheless offers the necessary great bending and torsion stability and on the other hand encloses the other structure parts. When desired, the easily inspected construction can be covered with a simple small removable cover of plastic material. Considerable material for the production of covering is saved.

BRIEF DESCRIPTION OF DRAWINGS

The nature, objects and advantages of the invention will be more fully understood from the following description of a preferred embodiment shown by way of example in the accompanying drawings in which:

FIG. 4 is a top plan view of the arrangement according to FIG. 3 in assembled condition whereby covered elements are shown in broken lines, the fastening case of the seat frame support being seen only in this figure.

FIG. 5 is a side elevation of the arrangement according to FIG. 4 with the axes cut and the protective cover removed with indicated adjusting means.

DESCRIPTION OF PREFERRED EMBODIMENT

Figure 1:
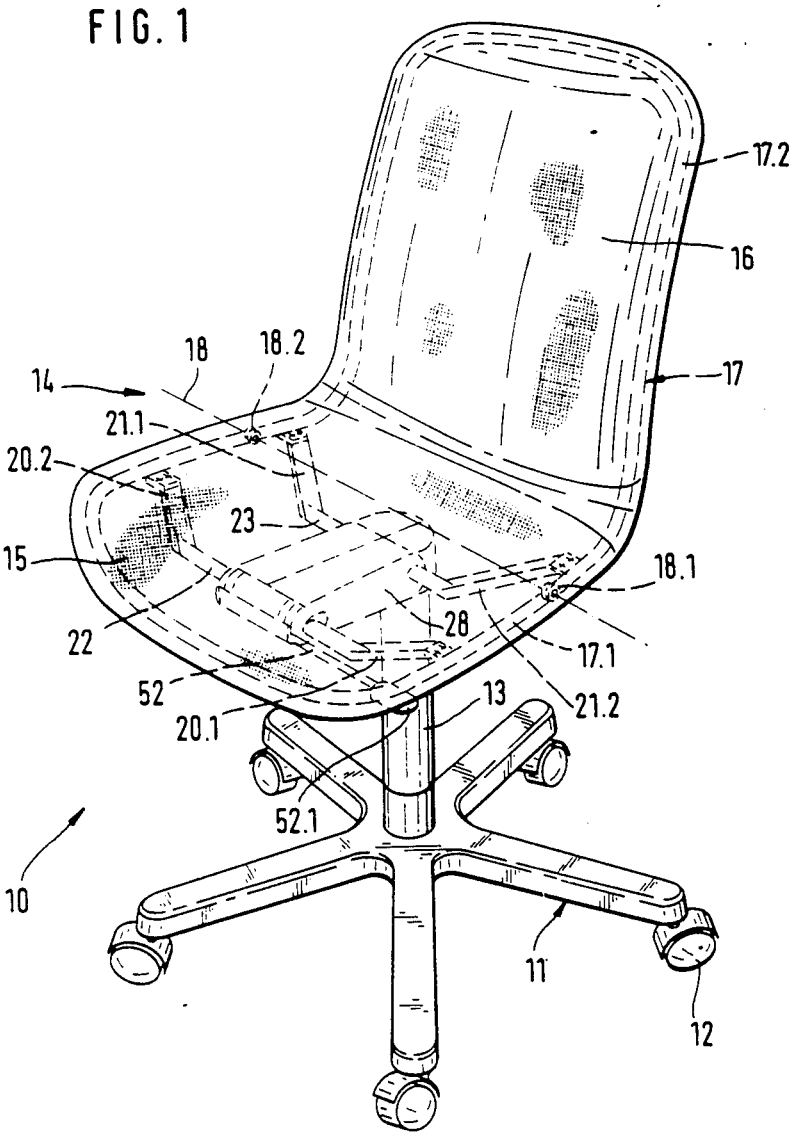
FIG. 1 is a partially schematic front perspective view of a work chair in accordance with the present invention.

The work chair 10 has a five arm pedestal 11 with the usual rollers 12 and a height adjustable column 13 as well as a body support 14 comprising a seat 15 and a backrest 16 which are mounted and supported on a frame 17 in a manner which will be further described below.

Instead of the frame 17, shell parts can be provided. However, in the following description, both constructions will be referred to as a frame.

Frame 17 comprises two frame parts namely a forward seat-frame part 17.1 and a rear seat and back frame part 17.2. These are connected by means of two hinge joints 18.1 and 18.2 lying on a hinge axis 18. The axis 18 lies in the region of the hip protuberance of the user. Therein a special feature is to be seen. The rear seat-frame part 17.3 serves through the cushion region of the rear seat part 15.3 to support the buttocks of the user and is essentially immovably joined with the back frame part 17.4 and the appurtenant cushioning 16.4. However, the cushioning is so formed that the back and lower spinal column parts always have essentially the same angle position relative to one another. On the foward seat region 15.1, the support for the thigh is formed in usual manner with a forward rounding 15.6 for support of the user's legs up to about the knee region.

The two seat frame parts are supported on the axes 22 and 23 by two seat frame supports 20 and 21. The seat frame supports are formed as attachment elements with fastening portions which are secured in suitable manner with the frame parts or shell parts, for example by screws or otherwise.

The rear pivot axis is formed as a fixed swivel axis 23 supported in a column support part 25. The column support part 25 has two column support webs 25.1 and and 25.2 which extend tangentially from a part-cylindrical connecting region 25.3. The column support part 25 is secured on the support tube 26 of the height-adjustable column 14 in suitable manner, for example by welding.

As the swivel axis 23 serves several purposes, it is formed of a plurality of parts. It has an inner bar-form support axis 23.1 and an axis tube 23.2 in which the support axis 23.1 is rotatable in plastic bearings (not shown).

The seat frame supports 21.1 and 21.2 are slipped on over the ends of the swivel axis 23 in the same manner that seat frame supports 20.1 and 20.2 are slipped on over the ends of the forward hinge axis of the same length which is formed as a sliding axis 22.

Figure 3:
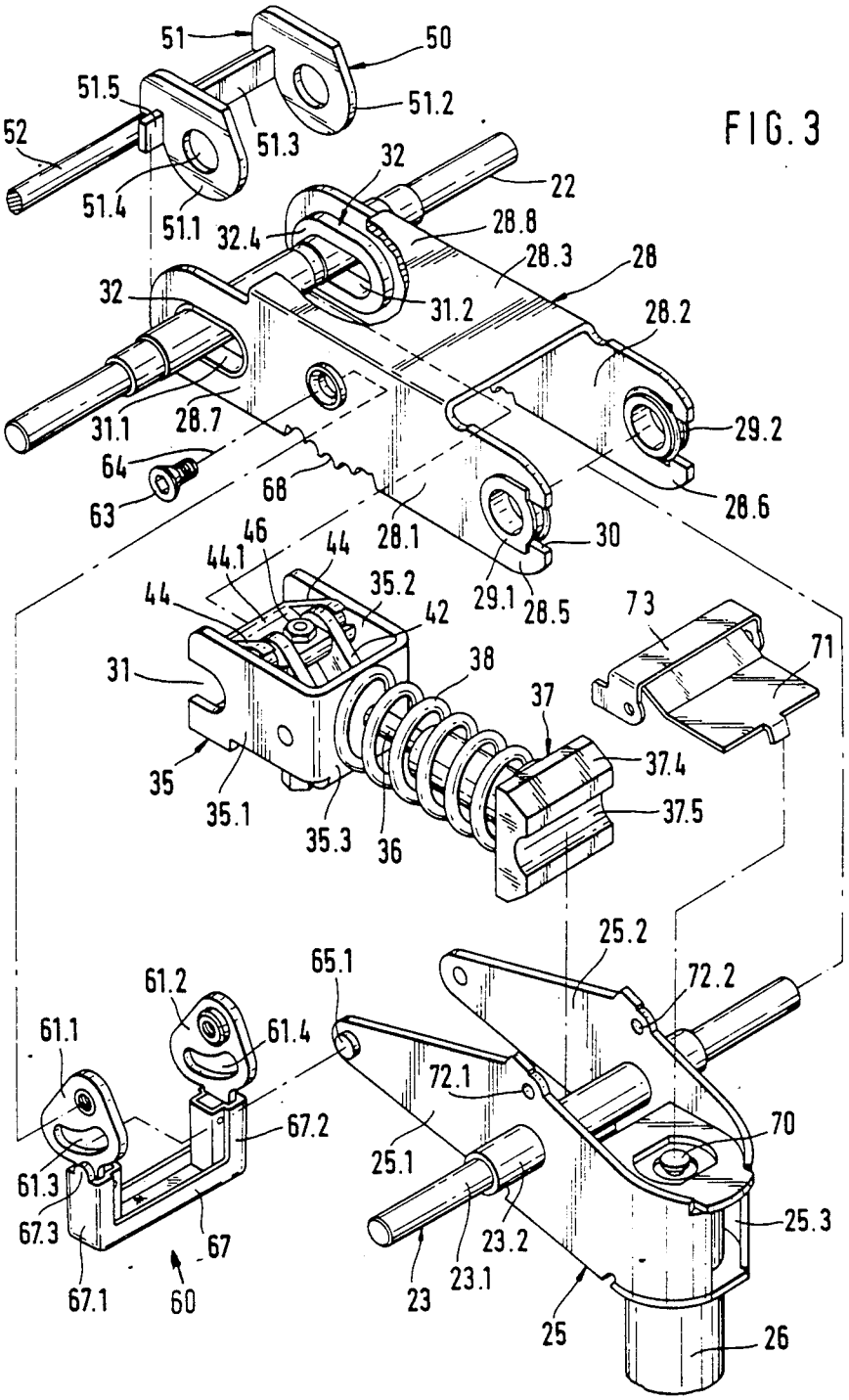
FIG. 3 is an exploded perspective view from the left and above of the support and adjustment mechanism of the chair without the seat and seat frame support.
Figure 8:
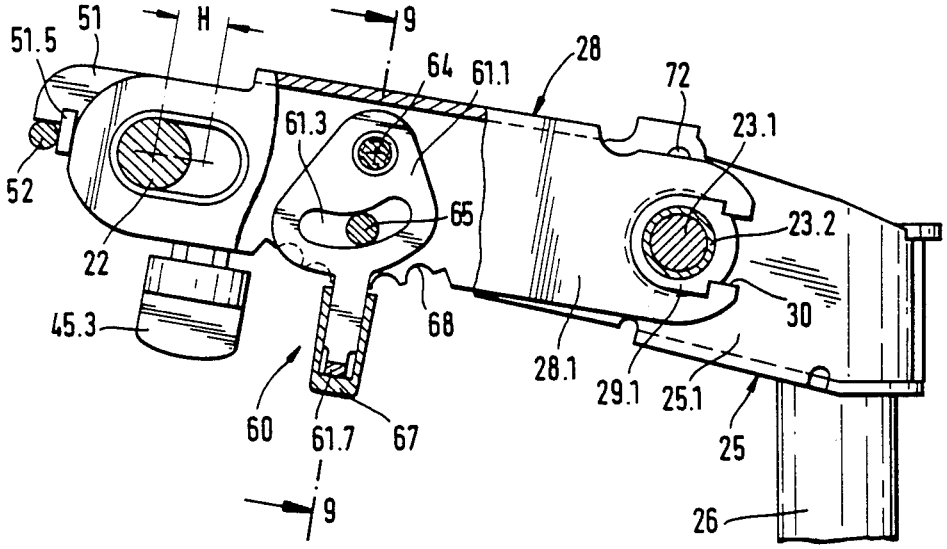
FIG. 8 is a side elevation corresponding to FIG. 5 but with the side wall broken away to show the inclination cam disc.

The sliding axis 22 is supported in a swivel support 28 which is constructed as a downwardly opening U-profile form part with two support shanks 28.1 and 28.2 as well as an upper connecting web 28.3. The swivel support part 28 embraces all of the other elements of the support, swivel and adjusting mechanism. The swivel support part 28 has in rear bearing reagions 28.5 and 28.6 of each of the shanks 28.1 and 28.2 recesses 30 which are profiled as seen in FIGS. 3,5 and 8 to receive plastic swivel bearings 29.1 and 29.2 which suitably and rotatably support opposite end portions of the axis tube 23.2. In the forward regions 28.7 and 28.1 of the shanks 28.1 and 28.2 of the swivel suport part 28 there are provided elongate openings 31.1 and 31.2 with inserted plastic slide bearings 32.1 and 32.2 having inner boundary collars 32.3 and 32.4.

The slide bearings 32 have a width corresponding to the diameter of the slide axis 22 and have a length permitting a movement or stroke H of the slide axis as seen in FIGS. 5 and 8 insofar as not presented by arresting of the spring as further described below.

The sliding axis 22 is spring-supported with respect to the swivel axis 23. The spring support, ajustable in its hardness or spring force, is especially seen from FIGS. 3,4,6 and 7. It comprises an upwardly and forwardly opening elbow lever housing 35 provided with a rear spring supporting wall 35.3 and a lower housing wall 35.4 as well as spring housing side walls 35.1 and 35.2. In the rear spring supporting wall 35.3, there is secured a guide pin 36 which extends rearwardly and on which a spring counter-bearing part 37 is slidably received. The spring counter-bearing part has a shaft portion 37.1 with a guide bore 37.2 which suitably receives and is guided by the guide pin 36. The spring counter-bearing part 37 has a support portion 37.4 in the end of which there is formed a part-cylindrical bearing surface 37 5. With this surface, the spring counter-bearing part 37 is supported on the axis tube 23.2 as particularly seen in FIG. 6. The compression spring 38 centered on the shaft 37.1 is formed as a strong helical compression spring and bears at one end on the support portion 37.4 of the spring counter bearing part 37 and on the other hand on the spring support wall 35.3 of the elbow lever housing 35 as seen in FIGS. 3,4,6 and 7.

Figure 7:
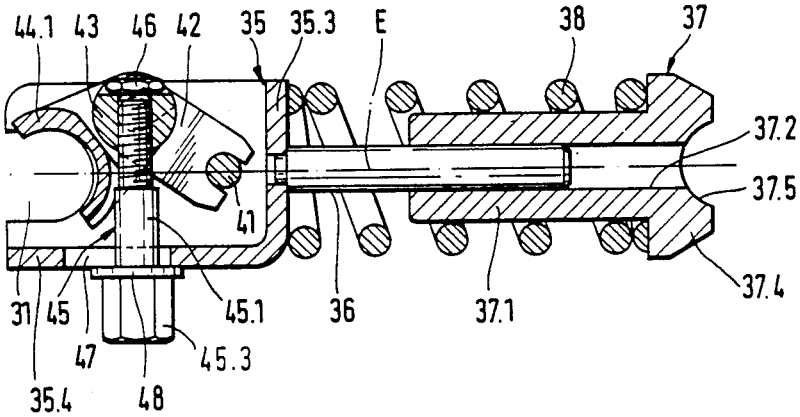
FIG. 7 is a longitudinal section through the spring support with elbow lever adjustment as seen in FIGS. 3,4 and 6, however, without the handle for adjustment.

In the elbow lever housing 35, a support pin 41 extends between and is secured in both side walls 35.1 and 35.2. It lies in the connecting plane E in which the axis of the guide pin 36 also lies. On the support pin 41, there is pivotally supported a double arm bell crank or elbow lever 32 which moreover is pivotally connected with the elbow element 43. With the elbow element 43, there is connected a foward double arm, elbow lever 44 which has a part-cylindrical bearing element 44.1 which bears directly on the forward sliding axis 22 and which has a wide recess corresponding to the spacing of the two arms in order to assure a stable support. The elbow element 43 has a central diametrical threaded bore receiving a set screw 45 having secured on its outer end a stroke-limiting nut 46. The set screw 45 has a shaft portion 45.1 which is slidably received in an elongate opening 47 in the elbow lever housing wall 45.4. Under the head 45.3 of the set screw 45, there is a washer 48 which enables a sliding of the set screw 45 along the opening 47 in the spring tension adjusting operation. It will be seen that through the in-and-out screwing of the set screw 45, which as seen in FIG. 7 is provided with a suitable large removable grip 45.4, the elbow lever in its spacing between the support pin 41 and the swivel axis 22 can be varied. Thereby the spring 38 is more or less tensioned. The elbow lever arrangement has a particular advantage in that with increasing spring tension, which naturally occurs progressively, there is less adjustment because the elbow lever takes a flatter position. As will be seen, the slide axis 22 can move rearwardly in the elongate opening 31 against the force of the spring 38. Thereby the entire elbow lever arrangement with the elbow lever housing 35 slides rearwardly. In order to make such movement impossible when it is not desired, there is provided a spring arresting device 50. Thereto, there is provided a U-profile bow-like arresting swivel lever 51. This consists of two arms 51.1 and 51.2 which are formed disc-shaped and which lie outside the side walk 35.1 and 35.2 of the elbow lever housing 35 and with suitable bearing holes 51.4 swivelly bear on the sliding shaft 22. As a forward connection, they have an arresting bar 51.3 which is inserted in the corresponding recesses in the disc-form arms 51.1 and 51.2 and welded in place. The arresting bar 51.3 has projecting end portions 51.5 and 51.6 which are as long as the swivel support part 28 is wide. Parallel thereto, there is welded a swivel rod 52 formed with handle portions 52.1 (FIG. 1) which lie under side portions of the seat 15 and serve for actuating the spring arresting device. The side walls 28.1 and 28.2 of the swivel support part 28 are formed in upper corner regions 28.9 of their forward regions 28.7 and 28.8 with a quarter-circle of which the center is the center of the forward half circles of the elongate bearing openings and which has a somewhat smaller radius than the spacing of the support surfaces 51.9 of the arresting ends 51.5 and 51.6 from the center of the slide axis 22. Moreover, the downwardly extending support region 53 is formed approximately tangential so that the arresting ends 51.5 and 51.6 can lie there and, as will be seen, prevent the slide axis 22 from sliding rearwardly. The arresting device 50 is rotatable about the sliding axis 22 to an upper, not illustrated, position in which the sliding axis is free to move rearwardly in the elongate openings because the arresting ends 51.5 and 51.6 lie parallel to the plane E.

The swivel support part 28 embraces the column support part 25 and is adjustable in inclination with respect thereto. There is provided an inclination adjusting device 60. This has two inclination cam discs 61.1 and 61.2 which can be seen in FIGS. 3,8 and 9. These are with bearing nuts 62 and bearing screws 63, mounted in the support webs 28.1 and 28.2 of the swivel support part 28 for rotation about an axis 64.

Figure 9:
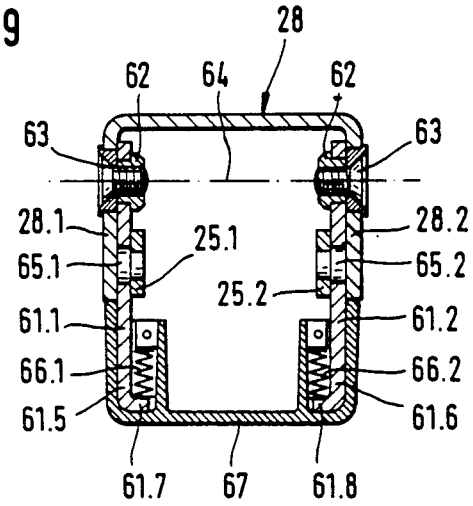
FIG. 9 is a cross section on the line 9—9 in FIG. 8 whereby only essentially the elements aligned in the plane of the section are shown and parts of the spring tension lying the intervening space are half-omitted.

The inclination cam discs 61 have curved cam slots 61.3 and 61.4 which, as seen in FIG. 8, are spaced considerable from the axis of rotation 64 and receive a coupling pin 65. The coupling pins 65.1 and 65.2 are respectively secured in the region of the forward ends of the column support part shanks 55.1 and 55.2 and project outwardly as seen in FIGS. 3 and 9 so as to engage respectively in the cam slots 61.3 and 61.4.

The inclination cam discs 61.1 and 61.2 have actuating arms 61.5 and 61.6 with inwardly bent spring support tongues 61.7 and 61.8 on which detent springs 66.1 and 66.2 are supported. As seen in FIG. 9, these engage the actuating bow 67. This is formed as a bow-form part connecting the two actuating arms 61.5 and 61.6 and slidable downwardly against spring force, and which has half-cylindrical form detent projections 67.3 and 67.4 on its side arms. These are so arranged that they can engage in half-circular detent recesses 68 which are arranged in an arc about the axis of rotation 64 and suitably spaced therefrom in the side walls 28.1 and 28.2 of the swivel support part 28 as shown in FIG. 5 and indeed arranged in part-circular form so that the inclination cam discs 61 can be rotated and held in several positions so that the relative height position of the sliding axis 22 with respect to the swivel axis 23 can be varied in order to adjust the seat and backrest initial inclination in a wide range.

In the support tube 26, there is provided an unillustrated height adjustment device of which the upper actuating end 70 will be seen in FIG. 3. In order to make a height adjustment, this actuating end 70 must be pressed. For this purpose, there is provided an actuating lever 71 which is tiltable in bearing bores 72.

Figure 6:
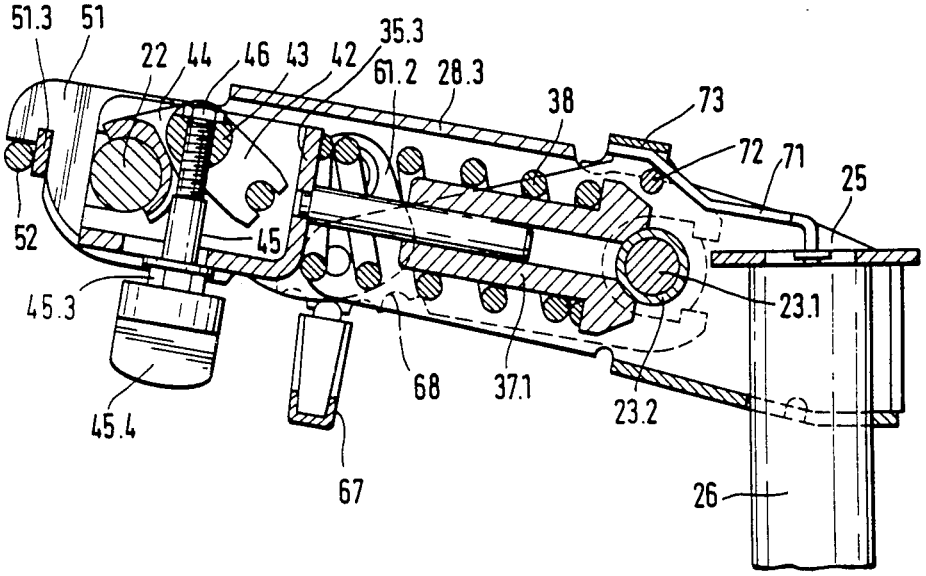
FIG. 6 is a longitudinal section through the essential elements of the device according to FIGS. 3 to 5.

The bearing bores 72, as seen in FIGS. 3 and 6 are formed in the upper-most regions of the column support shanks 25.1 and 25.2 and define the axis of the actuating lever 71. The swivel limiting tongues 73 form the cover-free support of the height adjusting device in its end position. The actuating lever is removable.

The work chair as described above is used as follows:

By means of an unillustrated handle, the height of the column 13 of the pedestal is adjusted in the usual manner by means of the actuating lever 71 to the desired initial height for the user.

Figure 2:
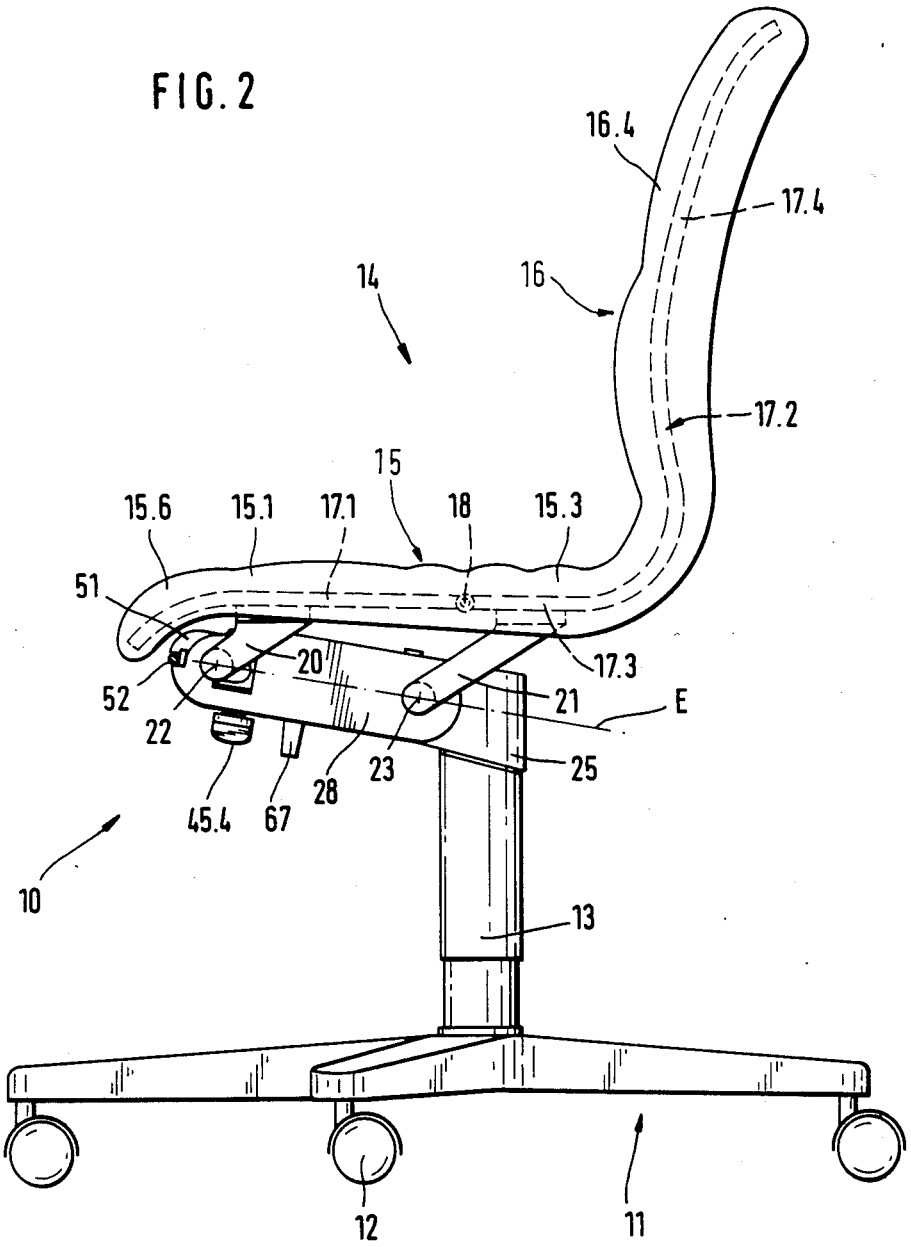
FIG. 2 is a partially schematic side elevation from the left side of the work chair shown in FIG. 1.

By means of the actuating bow 67, the initial inclination of the seat 15 and the backrest 16 are adjusted. Thereby the actuating bow 16 is pulled downwardly against the force of the springs 66 so that the detent projections 67.3 and 67.4 disengage the detent recesses 68. Through swinging the actuating bow 67 forwardly or rearwardly, the position of the plane E to the vertical column 13 or to the floor is adjusted in its inclination so that the sliding axis 22 is positioned at the desired height with respect to the swivel axis 23. Thereby this adjustment is so selected that the seat surface 15 for most users of the chair in the not-back-leaning position is agreeable. That means that most handwriting users will select an inclination in which the rear surface is not in horizontal initial position as illustrated in FIG. 2 but rather is inclined somewhat downwardly, forwardly so that the plane E lies approximately horizontal. In this position, the user can comfortably bend fowardly and write by hand without cutting off circulation in the legs through strong pressure on the forward edge region 15.6 of the seat 15.

Through turning the grip 25.4, the elbow lever can be more or less extended flat and thereby the initial tension of the spring 38 can be adjusted.

The user can now lean back and thereby the spring tension can be tested and easily regulated as desired. By this procedure, the spring arresting device 50 with its swivel rod 52 must be in its upper position so that the arresting ends 51.1 and 51.2 lie parallel to the plane E and permit free movement.

If the user now through erecting his upper body, takes the machine operating position, his lumbar vertebra will be supported by the curved portion of the backrest 17 in the corresponding region so that he sits upright and the back and spinal column assume a favorable position to one another whereby the seat 15, as shown in FIG. 2, has parts 71.1 and 71.3 aligned and the spring 38 is not yet compressed. It thereby follows that the back and buttocks are supported in correct anatomical position on the practically immovable frame 17.2 support unit comprising the rear seat part 15.3 and backrest 16. If now a relaxed or listening position is desired in which the back is tilted rearwardly, the user need only shift his weight rearwardly and thereby correspondingly press on the backrest 16. The rear seat portion 15.3 and backrest 16 then swing rearwardly about the fixed swivel axis 23 so that their relative angle position is unaltered so that the spinal column and back remain in the anatomically correct position. In this sense, is the concept "essentially unalterable angle" to be understood. Certain elasticity will always be present in the frame and/or shell construction or in the upholstery cushion and is also desired. However, there should be no linkage or easily bent elastic connection provided between the rear seat part and the backrest.

As a rule, when through pressure on the backrest pivoting about the swivel axis 23 occurs, the hinge axis 18 between the two seat parts moves downwardly relative to the swivel axis 23 as it moves on a corresponding arc and, in the preferred illustrated form of embodiment, never starts from the upper dead center position but from an initial position slightly rotated therefrom and hence by pivoting moves a not inconsiderable distance downwardly. Accordingly, the coupled forward seat portion 15.1 together with the forward seat frame part 17.1 is lowered about the sliding axis 22 whereby this, on account of fast coupling and the rigid form of the elongate opening 31.1 and its appurtenant slide bearing 31, is slightly lowered and moved rearwardly so that also the forward seat frame part 17.1 takes a position slightly inclined downwardly toward the rear, which however is inclined less that the inclination of the rear frame part 17.3 because it is further forward and provided with a long coupling lever arm in the forward seat frame part 17.1 and is accordingly taken along. The entire supporting surface of the seat 15 hereby takes a position inclined downwardly towards the rear whereby the elasticity of the seat construction through the frame or corresponding shell parts and the upholstering provides a uniformity so that there is no sharp break movement about the axis 18 in the upper region under the buttock. There is available suitable material for the covering, out of which seat upholstering with suitable waves as illustrated can be made. Thus, force components in the direction of the spinal column of the user to be supported are now almost perpendicular to the supporting surface of the seat while the components in the direction of the backrest are supported on the backrest. There is thus no sliding of the buttocks and thighs forwardly and thereby no sliding of the clothing. Also, the knees are not lifted practically at all because the sliding axis 22 is in the vicinity of the knees and thus arranged for slight sliding rearwardly and if necessary downwardly so that the forward seat region with the rounding 15.6 remains at practically the same height position. There occurs only a slight angular variation between the upper body and the thighs about the hip joint which however are favorably supported through the position of the hinge axes 18,22 and 23.

If the user again bends forwardly, the spring 38 presses the sliding axis 22 forwardly in the elongate openings 31.1 and 31.2 of the slide bearings 32 whereby the hinge axis 18 of the seat surface parts is drawn fowardly and thereby the rear seat part 15.3 and the backrest 16 swing back forwardly about the axis 23 to the initial position illustrated in FIG. 2.

If the user does not wish the back to move rearwardly except for the elasticity of the upholstering, even when strongly leaning back, the sliding axis 22 can be arrested in that the user can with the handle 52.1 and its appurtenant swivel rod turn the arresting device forwardly about the sliding axis 22 so that the arresting ends 51.5 and 51.6 can engage the support shanks 28.1 and 28.2 in line with the plane E and thereby prevent sliding movement of the sliding axis.

The angle between the plane E and the forward seat frame part 17.1 and the rear seat frame 17.3 in the extended position shown in FIG. 2 is about 10°. For the swivelling of the forward seat frame part 17.1 about the sliding axis 22 an angle range of about 3° is advantageous. For the swivelling of the rear seat and back frame part 17.2 about the swivel axis 23, an angle range of about 16° is advantageous. This relation of about 1:5 of itself would effect too great an angle inclination between the thigh and the back. The the elastic construction of the seat shell or other seat elements and the upholstery gives, however an equalization of the entire seat inclination so that as a whole the angular relation in the extreme back-leaning position is about 1:3.

In the illustrated embodiment, the support of the seat frame parts is shown with two part seat frame support, thus with a pair of seat frame supports on a continuous axis. Instead of such pair of seat frame supports, a one-piece seat frame support can be provided which is correspondingly pivoted. In this sense, the single seat frame support is considered the alternative of a pair of seat frame support. Thus for the invention it is important to the have the fewest swivel axes and appurtenant swivel links lying in a plane of the kinematic because it thereby distinguishes from many known constructions which have a large number of links and pivots but which however provide no better dynamic seat support. It is also especially advantageous that the rear pivot axis serves the multiple support of the seat frame supports 21.1, 21.2 and thereby the rear seat part and the back as well as on the other hand the pivoted support of the swivel support part 28 and moreover, the swivel support of the spring 28 over the spring counter bearing part 37 with the part-cylindrical bearing 37.5. There is thus attained on the one hand favorable force adjustment and on the other hand a plurality of swivel points concentrated on a multiple swivel member. In summary, the invention can be described as follows:

The work chair (10) has a seat divided into a foward seat part (15.1) and a rear seat part (15.3) of which the forward seat frame part (17.1) and rear seat and back frame part (17.2) are pivotally connected with one another with a pivot axis (18). The frame parts are supported on a pedestal (11) with seat frame supports (20,21). Thereby, the column (15) is provided with a column support part (25) which supports the swivel axis (23) and a swivel support part (28). On the swivel axis (23) seat frame supports (21) are mounted. The swivel support part (28) is by means of an inclination adjusting device with an actuating bow (67) tiltable in order to tilt a plane (E). The swivel support part (28) has in a forward part elongated bearing openings in which the slide axis (22) is slidable against the force an adjustable spring. The sliding axis (22) carries the seat frame support (20). The sliding axis (22) can by means of an arresting device having an arresting lever (5) with a swivel rod (52) is secured against sliding. The spring force can be adjusted by means of a bell crank or elbow lever operable by a handle 45.4. With the arresting lever in raised inoperative position, the backrest 16 can be pivoted about swivel axis 23 through pressure on the backrest with lowering of the surfaces of the seat 15 whereby the forward rounded seat region 15.6 maintains its height.

We claim:

1. A work chair comprising a base frame adapted to be supported on a floor, a seat divided along a transverse line into a forward seat portion having a rounded forward edge and a rear seat portion, hinge means hingedly joining said forward seat portion and said rear seat portion with one another, with a hinge axis on said transverse line, a backrest structurally joined with said rear seat portion at a substantially unalterable angle, first support means supporting said rear seat portion and backrest on said base frame for movement from a first forward position to a second rearwardly inclined position of said backrest accompanied by a lowering of said rear seat portion, second support means for supporting said forward seat portion on said base frame for movement from a first approximately horizontal position to a second position in which said forward seat portion is inclined downwardly to the rear while said rounded forward edge of said forward seat portion remains at substantially the same height from the floor, and spring means resiliently opposing movement of said backrest and seat portions from said first positions to said second positions.

2. A work chair according to claim 1, in which said first support means comprises a first support fixed to said rear seat portion, extending downwardly and forwardly therefrom and pivotally mounted on said base frame with a first pivot axis disposed below and forwardly of said axis of said hinge means joining said seat portions, and said second support means comprises a second support fixed to said forward seat portion, extending downwardly therefrom and pivotally mounted on said base frame with a second pivot axis forwardly of said first pivot axis.

3. A work chair according to claim 2, in which said base frame comprises a vertical support column and a support structure mounted on said column, and in which said first pivot axis is disposed forwardly of a first vertical plane containing the longitudinal axis of said support column and parallel to said first pivot axis, and said hinge axis between said forward seat portion and said rear seat portion is disposed between said first vertical plane and a second vertical plane containing said first pivot axis and parallel to said first vertical plane.

4. A work chair according to claim 2, in which the seat surface in said first position of said seat portions is disposed at an acute angle of a few degrees to a plane defined by said first and second pivot axes.

5. A work chair according to claim 2, in which said forward seat portion in moving from said first position to said second position moves through an angle of about 3° and said backrest in moving from said first position to said second position moves through an angle of about 16°.

6. A work chair according to claim 2, in which said first support comprises a first pivot shaft centrally supported by said base frame and two rear support members extending downwardly and forwardly from said rear seat portion and receiving ends of said first pivot shaft and in which said second support comprises a second pivot shaft centrally supported by said base frame and two forward support members extending downwardly from said forward seat portion and receiving ends of said second pivot shaft.

7. A work chair according to claim 6, in which said first pivot axis is fixed relative to said base frame and said second pivot axis is slidable fore and aft relative to said base frame, and in which said spring means comprises a compression spring acting between a fixed support and said second pivot shaft to oppose rearward sliding of said second pivot axis.

8. A work chair according to claim 7, further comprising means for varying the compression of said spring.

9. A work chair comprising a base frame, a seat and a backrest, said base frame comprising a vertical column, a first frame support fixed on said column and a second frame support extending forwardly of said first frame support and pivotally mounted on said first frame support for pivoting about a transverse horizontal axis, first support means for supporting said back rest on said base frame, said first support means comprising a first support pivotally mounted on said first frame support for pivoting about a first pivot axis extending transversely of said first frame support, second support means for supporting said seat on said base frame, said second support means comprising a second support pivotally mounted on said second frame support for pivoting about a second pivot axis extending transversely of said second frame support and forwardly of said first pivot axis, and means for varying the angular relation of said second frame support and said first frame support to one another and thereby varying the relative heights of said first and second pivot axes and the angular position of said seat and backrest when in a rest position.

10. A work chair according to claim 9, in which said means for varying the angular relation of said first and second frame supports to one another comprises at least one cam disc mounted rotatably on one of said frame supports cooperating cam follower means on the other of said frame supports, means for rotating said cam disc and means for retaining said cam disc in a selected rotary position.

11. A work chair according to claim 10 in which said first frame support comprises a first portion embracing and secured to said column and two integral parallel shanks extending forwardly from said first portion, and said second frame support comprises a pair of parallel side members joined with one another by a connecting web.

12. A work chair according to claim 11, in which there are two of said cam discs which have cam slots and are rotatably mounted respectively on said side members of said second support and in which said cam follower means comprise pins on said shanks of said first frame support engaged in said cam slots of said cam discs.

13. A work chair according to claim 12 in which detent recesses are provided in lower edges of said side members of said second frame support arranged in an arc concentric with the axis of rotation of said cam discs and in which said means for rotating said cam discs comprises an arm extending radially from each of said cam discs, a bow connecting said arms and detent means on said disc rotating means resiliently engageable with said detent recesses to retain said discs in selected rotational position.

14. A work chair comprising a base frame adapted to be supported on a floor, user supporting means comprising a seat and backrest, said user supporting means being divided along a transverse line into a forward portion and a rear portion, means hingedly connecting said forward portion and rear portion together along said transverse line, first support means for supporting said rear portion on said base frame, said first support means comprising a downwardly extending first support fixed to said rear portion and pivotally mounted on said base frame, second support means for supporting said forward portion on said base frame, said second support means comprising a downwardly extending second support fixed to said forward portion and pivotally mounted on said base frame forwardly of said first support means, said first and second support means providing for angular movement of said seat and backrest between first positions and second positions, spring means resiliently opposing movement of said seat and backrest from said first positions to said second positions, and means for varying the force of said spring, said spring force varying means comprising an elbow lever disposed between said spring means and a support, said elbow lever having two arms joined with one another at an angle, an elbow element rotatable in the angle between said arms of said elbow lever and a set screw acting on said elbow element to vary the angular position of said elbow lever.

15. A work chair according to claim 14, in which the pivoted mounting of a first one of said supports comprises a first pivot with a first pivot axis which is fixed with respect to said base frame and a second one of said supports comprises a second pivot with a second pivot axis which is parallel to and movable toward and away from said first pivot axis, and in which said spring means comprises a compression spring between said two pivots, said spring and said elbow lever being disposed in a plane defined by said pivot axes.

16. A work chair according to claim 15, in which said elbow lever is pivotally mounted in an upwardly and forwardly opening housing having parallel side walls, a rear wall forming a support for a first end of said spring and a lower wall having an opening through which said set screw extends.

17. A work chair according to claim 16, in which a spring guide pin projects rearward from said rear wall of said housing and in which a guide sleeve in said spring and having a collar portion abutting a second end of said spring is slidable on said guide pin.

18. A work chair according to claim 17, in which said first pivot comprises a first pivot shaft, and in which said collar portion of said guide sleeve has in an end thereof a part-cylindrical recess in which said pivot shaft is received and provides a support for said guide sleeve and said second end of said spring.

19. A work chair according to claim 18, in which said second pivot comprises a second pivot shaft and in which one arm of said elbow lever has at its end a part-cylindrical recess portion bearing on a pin extending between side walls of said housing and the other arm of said elbow lever has at its end part-cylindrical recess portion bearing on said second pivot shaft.

20. A work chair according to claim 15, further comprising releasable arresting means for preventing when in an operative position, movement of said second pivot toward said first pivot.

21. A work chair according to claim 20, in which said arresting means comprises at least one arresting lever pivotal about the axis of said second pivot and having a hook portion engageable with a fixed part of said base frame, when in operative position, to prevent movement of said second pivot toward said first pivot and swingable to a release position in which movement of second pivot toward said first pivot is permitted.

22. A work chair having body supporting surfaces comprising a seat and a backrest, said body supporting surfaces being divided along a transverse line into a forward portion and a rear portion, means hingedly connecting said forward portion and rear portion together along said transverse line and means for individually supporting said forward and rear portions, said supporting means comprising a pedestal having a vertical column, a first U-shape support component fixed to said column and having two spaced parallel shank portions extending forwardly therefom, a second U-shape support component nested with said first U-shape support component and extending forwardly of said first U-shape support component, said second U-shape support component comprising two spaced parallel shank portions lying against said shank portion of said first U-shape support component and a transverse web connecting said two spaced paralled shank portions of said second U-shape support component with one another, a first transverse pivot shaft pivotally connecting a rear portion of said second U-shape support component with said first U-shape support component, a second transverse pivot shaft supported by a forward portion of said second U-shape support component, means for supporting said rear portion of said user supporting means comprising a first support extending down from said rear portion and pivotally supported by said first pivot shaft, and means for supporting said forward portion of said user supporting means comprising a second support extending down from said forward portion and pivotally supported by said second pivot shaft.

23. A work chair according to claim 22, in which said second transverse pivot shaft is supported by said forward portion of said second U-shape support component for movement toward and away from said first transverse pivot shaft and in which a compression spring acting between said pivot shaft opposes movement of said second pivot shaft toward said first pivot shaft.

* * * * *